United States Patent [19]

Belanger et al.

[11] 4,427,049

[45] Jan. 24, 1984

[54] POWER OPERATED BI-FOLD STRIP CURTAIN DOOR ASSEMBLY

[75] Inventors: James A. Belanger, Northville; Robert J. Wentworth, Ann Arbor; Douglas J. Calvin, Livonia; James M. Lapham, Northville, all of Mich.

[73] Assignee: Belanger, Inc., Northville, Mich.

[21] Appl. No.: 212,372

[22] Filed: Dec. 3, 1980

[51] Int. Cl.[3] ..... E05D 15/26

[52] U.S. Cl. ..... 160/199; 160/332

[58] Field of Search ..... 160/1–6, 160/118, 199, 206, 207, 332, 126

[56] References Cited

U.S. PATENT DOCUMENTS

| | | | |
|---|---|---|---|
| 687,035 | 11/1901 | Kinnean | 160/207 |
| 1,162,231 | 11/1915 | Fritz | 160/118 |
| 1,581,854 | 4/1926 | Moy | 160/199 |
| 1,758,600 | 5/1930 | Grassi | 160/199 |
| 1,949,224 | 2/1934 | Toelle | 160/126 |
| 1,963,321 | 6/1934 | Yowell | 160/118 |
| 2,895,728 | 7/1959 | Edelman | 160/118 |
| 3,614,975 | 10/1971 | Aymond | 160/118 |
| 4,289,190 | 9/1981 | Catan | 160/332 |

*Primary Examiner*—Peter M. Caun

*Attorney, Agent, or Firm*—Cullen, Sloman, Cantor, Grauer, Scott & Rutherford

[57] ABSTRACT

The power operated bi-fold strip curtain door assembly is well-suited for doorways and openings to conserve energy and has applications, as an example, in the car wash industry and in industrial plants. Strip curtain supporting inboard and outboard sections are hinged together at next adjacent side edges in side-by-side relation. The inboard section is suspended from an overhead track by a carriage guidingly engaged with the track. A fluid power actuator, when energized, operates to fold and extend the door sections to respectively open and close the strip curtain door. One of the door sections has a side edge strip curtain upper horizontal hem portion reinforced such that its vertical border portion extends laterally in the plane of the strip door section a predetermined distance therebeyond. With the bi-fold door extended, the border portion is moved into overlapping flush relation to the neighboring strip curtain section providing a seal therebetween. Sensors, as an example, are located on one or both sides of the doorway for signaling the door actuators. Upon sensing the presence of a vehicle, the bi-fold curtain door assembly automatically folds open avoiding contact with the vehicle, as it passes through the doorway.

6 Claims, 7 Drawing Figures

POWER OPERATED BI-FOLD STRIP CURTAIN DOOR ASSEMBLY

BACKGROUND OF THE INVENTION

This invention relates to flexible strip curtain doors and more particularly to a power operated bi-fold strip curtain door.

Flexible strip curtain doors are finding ever increased use at open doorways to keep warm or cooled air inside the closed area. One problem with such strip curtain door installations is the application to vehicle access doorways wherein the plastic strips are subject to excess wear and damage by heavy traffic patterns found, for example, in car wash installations, enclosed parking garages, industrial plants, etc.

Thus, the invention herein relates to a flexible strip curtain power operated bi-fold vehicle door assembly which provides extended service life together with solving other problems and limitations of prior strip curtain doors.

SUMMARY OF THE INVENTION

The invention herein contemplates a power operated bi-folding strip curtain door that insures against heat or cool air losses or energy losses at vehicle access doorways. The door comprises a plurality of rigid folding upper sections hinged together in a side-by-side manner. Each section supports a group of flexible hanging strip curtains in overlapping relation to each other. A feature of the invention resides in the juncture of adjacent groups of strip curtains being sealed by means of an overlapping flexible outermost strip that is reinforced along its upper horizontal edge. The outermost reinforced strip thus projects laterally in the plane defined by its associated curtain strips. Upon operation of the door actuator, the reinforced strip curtain border is moved into overlapped engagement with the outermost strip of a neighboring group of strip curtains so as to provide a seal therewith.

The upper sections are hinged together in side-by-side relation for movement between door forming unfolded or extended positions and door folded positions wherein the doorway is open. The inboard section is supported from an overhead trackway by its carrier. The outboard section is pivotally connected at its outermost end to an upright defining one side of the doorway space. A cylinder and piston actuator has its blind end pivoted to a support arm extending from the upright with its piston rod free end pivoted to a mid portion of the outboard section. With the outboard section in its folded position, the piston rod is oriented substantially normal to the plane of the section such that a third class lever arrangement is provided. This feature results in maximum mechanical advantage being achieved during the initial movement of the door sections from their folded to their extended position.

These and other features and advantages of the present invention will become apparent upon reading the following description, of which the attached drawings form a part.

DETAILED DESCRIPTION OF THE INVENTION

Figure 1:
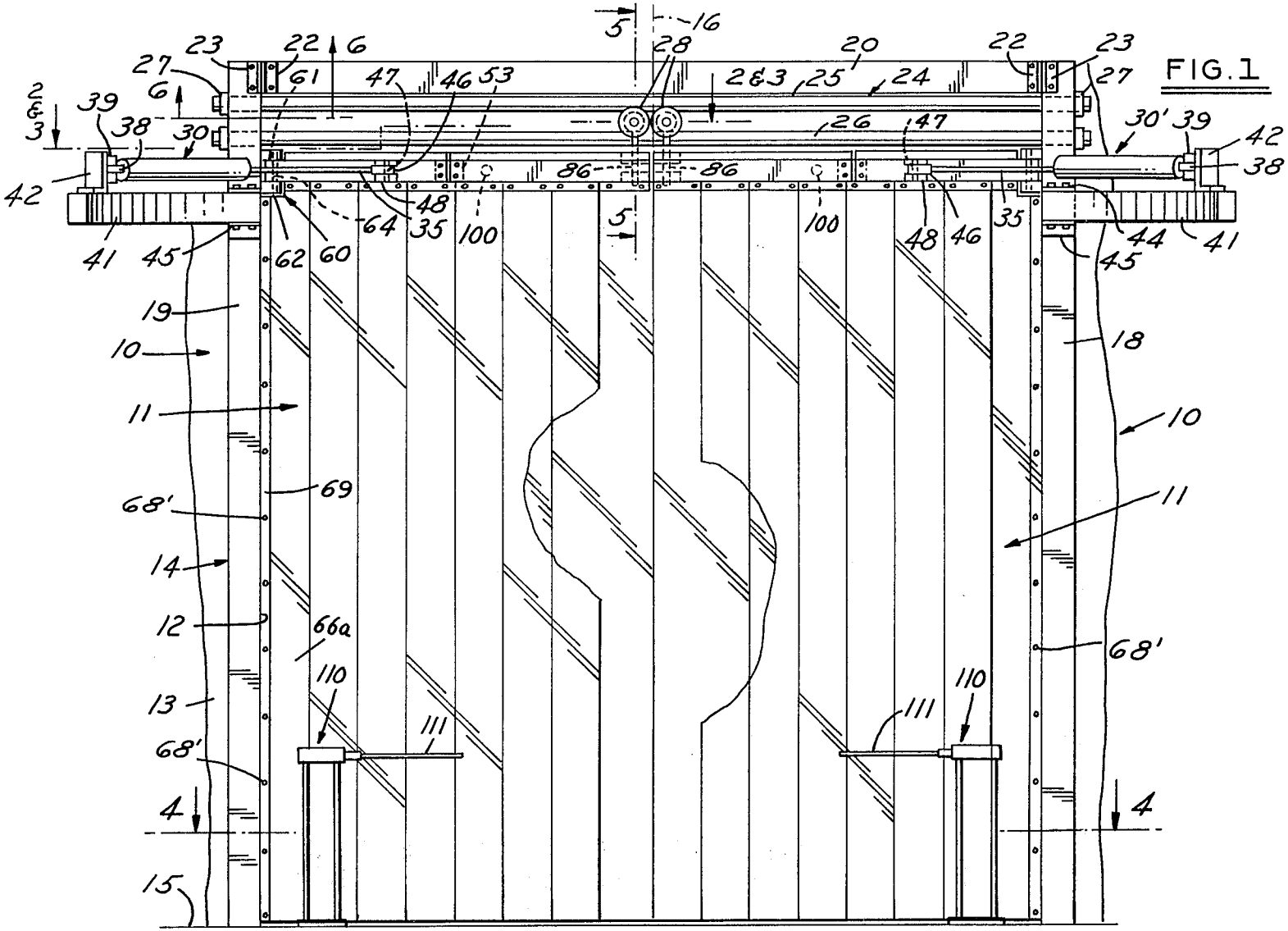
FIG. 1 is a front elevational view of a power operated bi-fold strip curtain door assembly in accordance with the present invention.

Referring now to the drawings in detail, wherein like numerals indicate like or corresponding elements, there is seen in FIG. 1 right and left hand bi-fold door assemblies generally indicated by the reference numeral 10. The door assemblies include bi-fold doors or door means 11, as an example in the form of strip curtains, closing a doorway space or opening 12 in the wall 13 defined by an inverted U-shaped frame indicated generally at 14 supported on a floor 15. The frame 14, symmetrical about center line 16, includes vertically disposed columns or door jamb uprights 18 and 19, and a horizontally disposed bridge portion or box header 20 spanning the uprights. Thus, the uprights 18, 19 and header 20 define an access opening enabling pedestrians or vehicles to pass through such opening.

Figure 6:
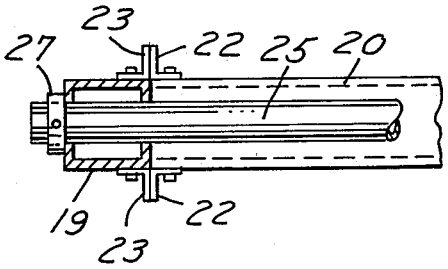
FIG. 6 is an enlarged fragmentary vertical sectional view taken substantially on line 6—6 of FIG. 1.

The header 20 is secured at each end to the uprights 18, 19 by suitable means such as pairs of angle brackets 22 and 23. An elongated overhead track 24 is supported beneath the header 20 and coextensive therewith. The track 24 includes parallel vertically spaced upper and lower tubes 25 and 26 with the free ends of the tubes 25, 26 extending through aligned apertures in each of the uprights 18, 19. FIG. 6 shows the tube outer ends secured by collars 27. Carriage means including guide rollers 28 are provided with annular concave recesses 29 conforming with the tubes 25, 26 to allow rolling engagement intermediate the tubes.

As seen in FIG. 1, fluid powered linear door actuators generally indicated at 30, are duplicated on each side of the doorway for each right and left hand door assembly 10. It is conceivable under certain circumstances that a single door assembly would suffice to close the doorway opening 12, but the preferred embodiment of the present invention utilizes duplicate or double door assemblies with one on each side of the doorway center line 16.

It will be seen in FIG. 1 that the left hand door assembly is a mirror image of the right hand door assembly and the remaining parts are of the actuator means and their control are duplicates whether they are used on the left or right hand side of the door. Therefore, the same number will be used in reference to a particular part with only the left hand door assembly 10 and its related actuator means 30 discussed in detail.

Figures 2, 4, 7:
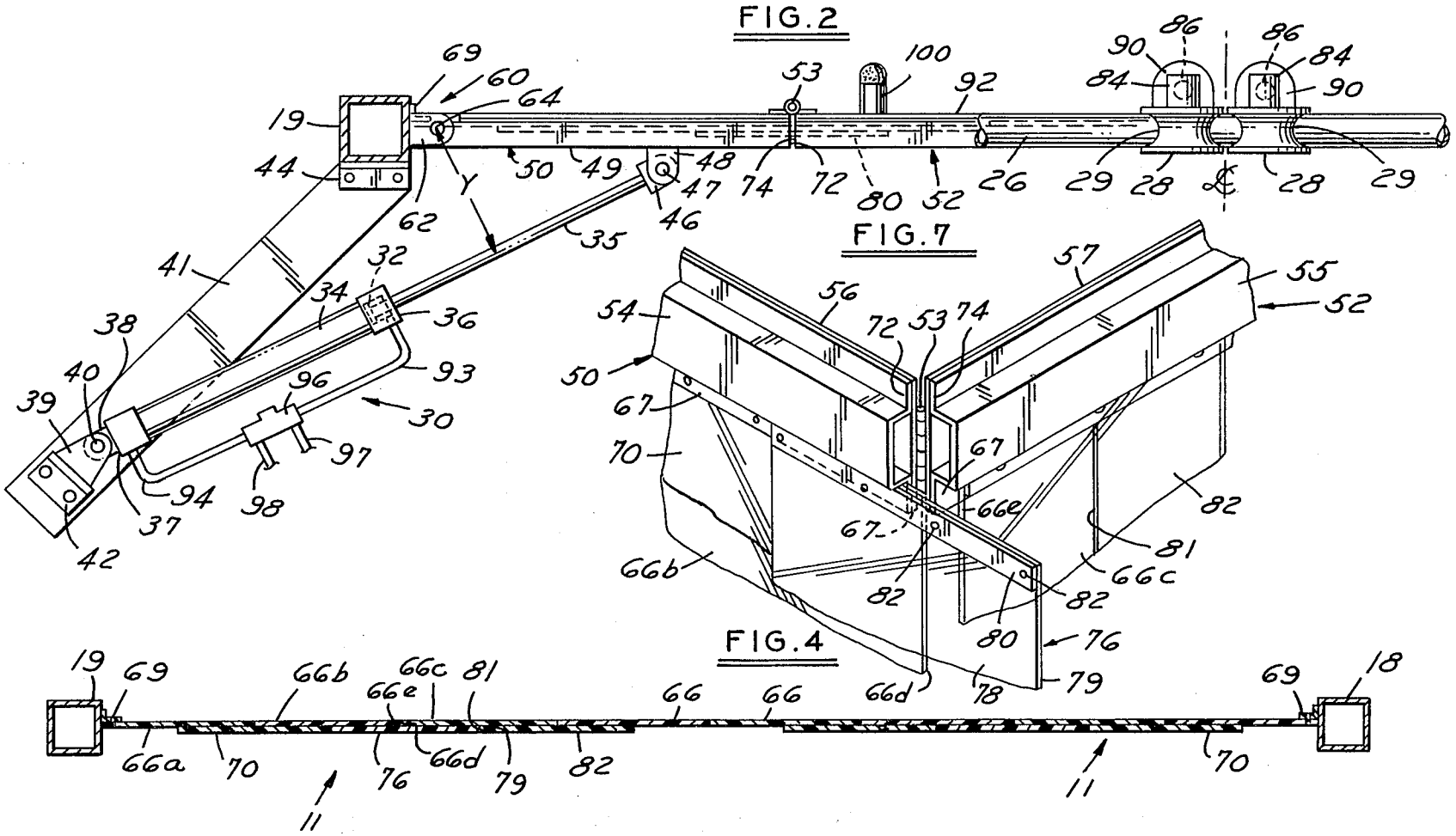
FIG. 2 is a fragmentary vertical sectional view taken substantially on the line 2—2 of FIG. 1.
FIG. 4 is a horizontal fragmentary vertical sectional view taken substantially on line 4—4 of FIG. 1.
FIG. 7 is an enlarged fragmentary perspective view of the fold juncture between adjacent strip curtain sections.

As best seen in FIG. 2, the actuator 30 in the preferred embodiment is specifically a double-acting control piston 32, reciprocably slidable within an operating cylinder 34. A piston rod 35 is connected at one end to the piston, and extends outwardly through the end wall 36 of the cylinder. The outer end of the piston rod 35 is pivotally attached to the bi-fold door 11 in a manner to be discussed.

The cylinder 34 is pivotally mounted at its opposite blind connected end 37 by means of a lug 38 joined to a clevis 39 by a pivot pin 40. The clevis is anchored to the outer end of a cantilevered arm 41 by means of an angle bracket 42. Cantilevered arm 41 is fixed to the upright 19 by upper and lower angle brackets indicated at 44 and 45 in FIG. 1. Piston rod free end has a tab 46 formed with an eye which is joined by pin 47 to a U-shaped clevis 48. Clevis 48 is suitably affixed as by welding to one exterior face of an outboard door section generally indicated at 50.

The bi-fold door 11 includes a pair of laterally positioned or side-by-side rigid support sections 50 and 52 hinged together at their opposed next adjacent ends by first hinge means in the form of a double leaf hinge 53. As best seen in FIG. 7, each of the outboard and inboard sections 50 and 52 include a channel shaped beam member 54 and 55, respectively. Each of the beams 54 and 55 have their open channels closed by plate members 56 and 57 coextensive therewith to form flanged box-beam sections.

The outermost end of outboard section 50 is pivotally connected to the upright 19 by second hinge means in the form of a gate-type hinge of knuckle joint generally indicated at 60. The hinge joint includes an annular projection or knuckle 61 having a vertical bore with the knuckle fitted within U-shaped yoke or bracket 62 to receive a vertical pivot pin 64.

Figure 5:
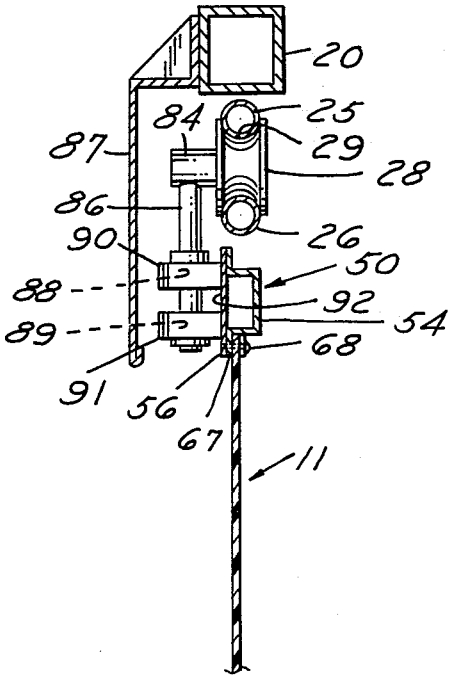
FIG. 5 is a fragmentary vertical sectional view taken on line 5—5 of FIG. 1.

As seen in FIGS. 5 and 7, each of the sections 50 and 52 support a number of flexible interior strips 66 at their upper horizontal edges along the lower flange portion 67 of the beams 50,52 by suitable fasteners such as hanger machine bolts, rivets or fasteners 68. Each of the strips 66 is preferably formed of transparent flexible plastic material such as polyvinyl chloride. Each strip is generally the same as its neighboring strips and may be provided in various widths with a typical strip having a width of 12 inches and a thickness of 0.120 inches.

As seen in FIG. 7, the section 50 outermost strip **66*a* has its vertical edge suitably secured by rivets or other fasteners 68' to the adjacent upright 19 such as by a vertically extending coextensive angle member 69. In the preferred form, the interior strips 66 have full overlapping exterior strips 70 which are hung from the flanges 67 by means of the fasteners 68 which are also used to support the interior strips 66**.

As best seen in FIG. 7, folding juncture of door 11 is defined by the opposed ends 72 and 74 of the sections 50 and 52, respectively. A curtain exterior bridging strip 76 overlaps the juncture between the terminal interior strips **66*b* and 66*c*. Lateral projecting border portion 78 of strip 76 extends beyond the vertical edge 66*d* of the strip a predetermined distance so as to overlap the juxtaposed edges 66*d* and 66*e* of the neighboring terminal strips 66*b* and 66*c*, respectively. Reinforcing means such as a stay bar 80, is suitably affixed along the upper horizontal hem portion of the bridging strip 76 such as by rivets or fasteners 82. In this manner edge 79 of strip 76 is maintained in juxtaposed abutting relation with edge 81 of exterior strip 82 seen in FIG. 4**.

It will be noted in FIG. 7 that the inside strip **66*c* has its free edge 66*e* disposed so as to be recessed from the section flange edge 74. Because of this set back edge arrangement, the strip vertical edge 66*d* extends beyond its associated section inner edge 72 forming a scarf joint with its neighboring strip 66*c* upon the sections 50 and 52 being extended to their door closure position. By virtue of this arrangement, the bridging strip border portion 78 is moved into flush sealed contact with the neighboring strips 66*c* with extension of the piston rod 35 defining a lapped seal for the juxtaposed edges 66*d* and 66*e***.

As mentioned above, the carriage means guide roller 28 is supported between the upper and lower tubes 25 and 26 of the overhead track by means of rolling engagement therebetween. The guide roller includes an axial stub shaft 84 extending transversely towards the interior of the doorway opening. The stub shaft 84 supports a vertically disposed carriage pivot pin 86 extending downwardly therefrom so as to be received in aligned apertures 88 and 89 respectively, of a pair of spaced horizontally disposed carriage journals 90 and 91 suitably secured on the interior surface 92 of inboard section 52 such as by welding. A cover or protective shield 87, supported on header 20, partially encloses the carriage and track mechanism as shown in FIG. 5.

Figure 3:
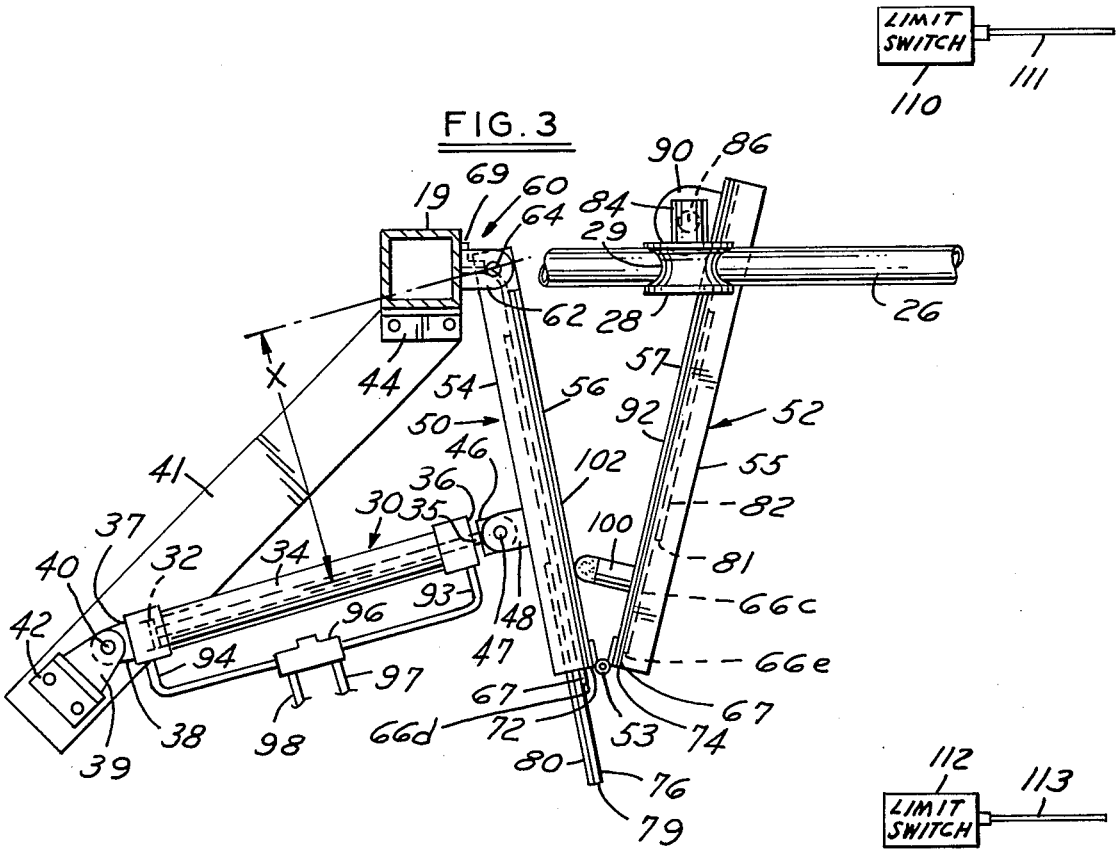
FIG. 3 is a view similar to FIG. 2 with the strip curtain door shown in its folded position.

With reference to FIGS. 2 and 3, it will be seen that the fluid actuator 30 is preferably in the form of an air actuated cylinder 32 with the opposite ends 36 and 37 of the air cylinder connected by suitable air lines 93 and 94 to a control valve 96. A control arrangement is provided wherein the valve 96 is automatically operated to control the opening and closing of the bi-folding curtain doors 10. Thus, fluid such as air is fed from a pressure source by suitable line means 97 and 98 into the front end portion of the cylinder 32 to thereby retract the piston rod 35 to the position shown in FIG. 3 wherein the door sections 50 and 52 are folded outwardly to allow a vehicle to pass through the doorway. The actuator 30 causes the guide roller 28 to be rolled within the track in a lateral outer direction towards upright 19 while the sections 50 and 52 are pivoted about their first hinge means 53.

It will be noted in FIG. 3 that with the sections in their folded position the principal axis of the cylinder 32 is located substantially normal to the section 50. The orientation of the cylinder 30 is achieved by having the longitudinal axis of the cantilever arm 41 diverging outwardly from the plane of the doorway opening at an obtuse angle of about 135°. Thus, upon air being fed into the blind end 37 of the cylinder maximum mechanical advantage of the actuator means is achieved for transmitting force from the piston rod to the outboard section 50. This results with the lever arm indicated at "X" in FIG. 3 being of maximum length as compared with the lever arm indicated at "Y" in FIG. 2.

FIG. 3 shows a stop member 100 extending normal from the surface 92 of section 52 contacting surface 102 of section 50. The stop member 100 cushions the bi-fold door 11 upon the sections being folded into their V-shaped configuration. It will be seen that the stop member 100 contacts the section 50 intermediate its first hinge connection 53 and the pivot pin 47 connection for the actuator means 30. Thus, stop member 100 operates, upon the extension of rod 35, to transfer the load from the section 50 to section 52 to insure smooth operation of the carriage roller means on track 24.

As stated above, it is within the contemplation of the invention that the doors can be operated automatically with the control valves 96 including solenoid valve means to control the admission of fluid presure to the cylinder 32. The doors are operated automatically, for example, upon a vehicle entering the area adjacent the interior of the door space. Such an arrangement would further include a limit switch 110 of the type having a feeler arm 111 engageable with the vehicle to establish an initial electrical signal to initiate operation of the solenoid controlled valve 96 as a vehicle enters an area, such as a car wash doorway within the apparatus is installed. The vehicle would operate the limit switch to energize the valve 96 and cause the curtain door 11 to be folded to their doorway open position. Further travel of the vehicle through the doorway causes limit switch 112 to be energized through actuation of feeler arm 113 to cam along the vehicle body effecting operation of the control mechanism and reversal of the valve 96. This extends the piston rod 35 so as to move the bi-folding curtain door sections 50 and 52 to their extended doorway closed position.

It is within the contemplation of the present invention that the cylinder 32 could be single acting wherein compression spring means normally urge the piston rod 35 into its extended position. With such an arrangement upon a malfunction, such as loss of pressurized fluid to the cylinder, the piston rod would be extended by the spring biasing means whereby the bi-fold curtain door sections would be moved to their FIG. 2 doorway closed position.

We claim:

1. A strip curtain bi-fold door assembly adapted for use in a door space defined by an overhead track, a floor and a pair of spaced apart uprights, said door assembly comprising:

at least a pair of laterally positioned inboard and outboard door means having opposed adjacent ends and free ends for closing at least a part of the door space, each said door means including support means for suspending a group of elongated flexible strip curtains in overlapping relation;

first hinge means for connecting the opposed adjacent ends of said door means;

second hinge means adapted to connect the free end of the outboard door means to one of the uprights;

carriage means adapted to guidingly engage the track for travel therealong;

said carriage means including pivot pin means adapted for suspending the inboard door means adjacent its free end for pivotal movement during travel of said carriage means; and fluid actuator means adapted to be interconnected between one of said door means and said one upright and effective when actuated to move said door means and their associated group of strip curtains between a folded position adjacent said one upright and an extended side-by-side position across the door space;

said fluid actuator means being in the form of a piston and cylinder having one end pivotally connected to said one upright and an extensible and retractable piston rod extending from said cylinder other end with the rod pivotally connected to said outboard door means;

said outboard and inboard door means having terminal interior strip curtains at their opposed adjacent ends, one of said door means having a terminal exterior strip curtain vertical border portion extending laterally a predetermined distance beyond the associated opposed adjacent end of said one door means;

means reinforcing the upper horizontal edge of said terminal exterior strip curtain such that its border portion is maintained in the plane of an associated group of exterior strip curtains overlapping said interior strip curtains, whereby upon said door means being extended said terminal exterior strip curtain border portion overlapping the next adjacent terminal interior strip curtain of the other door means such that a lap seal is provided at the juncture of said outboard and inboard groups of curtain strips; and said door means in their folded position having a V-shaped configuration with first interior surface of said door means facing inwardly in opposed relation; and second exterior surfaces of said door means facing outwardly;

the axis of said fluid actuator means disposed substantially normal to said outboard section exterior surface in its folded position, such that during the initial extension of said piston rod, the mechanical advantage of said actuator means in transmitting force from said piston rod to said outboard section is at a maximum.

2. The assembly as set forth in claim 1 wherein:

regulating means are provided for supplying pressurized fluid for energizing said actuator means;

control means for said regulating means including first switch means operating said actuator means causing said door means to be moved to their folded position; and said control means including second switch means operating said actuator means causing said door means to be moved to their extended position.

3. The assembly as set forth in claim 2 wherein:

said first switch means responsive to the presence of a vehicle in the area adjacent one side of said door space operating said actuator means causing said door means to be moved to their folded position; and said second switch means responsive to the presence of the vehicle in the area adjacent the other side of said door space operating said actuator means causing said door means to be returned to their extended position.

4. The assembly as set forth in claim 2 having a second pair of door means each supporting a group of elongated flexible strip curtains, said second pair of door means similarly mounted and arranged on the other upright and overhead track to provide double door assemblies operable in a substantially simultaneous manner by said control means to open and close said door space.

5. The assembly as set forth in claim 1, wherein:

said inboard door means interior surface having a stop-projection extending therefrom operative to contact the opposed interior surface of said outboard door means intermediate said first hinge means and said piston rod pivotal connection to define an included acute angle between said first interior surfaces;

said outboard door means operative as a third class lever wherein said projection transfers the actuator load from said outboard door means to said inboard door means to insure uninterrupted travel of said carriage means on said track.

6. The bi-fold door assembly defined in claim 1 wherein said carriage means includes a guide roller for the track, said roller having a stub shaft which supports said pivot pin means.

* * * * *